United States Patent [19]

Tanaka

[11] Patent Number: 4,875,872

[45] Date of Patent: Oct. 24, 1989

[54] TELEPHONE CONNECTOR

[75] Inventor: Masanori Tanaka, Osaka, Japan

[73] Assignee: Hosiden Electronics Co., Ltd., Osaka, Japan

[21] Appl. No.: 262,643

[22] Filed: Oct. 26, 1988

[30] Foreign Application Priority Data

Nov. 4, 1987 [JP] Japan ..... 62-169112[U]

[51] Int. Cl.[4] ..... H01R 4/50

[52] U.S. Cl. ..... 439/344; 439/83; 439/607; 439/746

[58] Field of Search ..... 439/741, 733, 607–610, 439/676, 344, 901–906, 55, 78, 83, 746

[56] References Cited

U.S. PATENT DOCUMENTS 4,623,211 11/1986 Dambach et al. ..... 439/607
4,643,509 2/1987 Hollyday et al. ..... 439/607
4,678,121 7/1987 Douty et al. ..... 439/610
4,679,883 7/1987 Assini et al. ..... 439/607
4,732,568 3/1988 Hall ..... 439/607

FOREIGN PATENT DOCUMENTS 0040941 12/1981 European Pat. Off. ..... 439/610

*Primary Examiner*—David Pirlot
*Attorney, Agent, or Firm*—Pollock, Vande Sande and Priddy

[57] ABSTRACT

Terminals are held in a connector body of an insulating material and the connector body has engaging grooves cut into both sides and extending in its front-to-back direction. A U-shaped metal cover is locked to the connector body, with both side marginal portions of the cover fitted into the engaging grooves of the connector body.

7 Claims, 5 Drawing Sheets

TELEPHONE CONNECTOR

BACKGROUND OF THE INVENTION

The present invention relates to a telephone connector for connecting a telephone set to a line wire or interior wire.

A telephone connector 2 is attached to a telephone set body 1 as shown in exploded form in FIG. 1, for example. In the telephone set body 1 there is provided a printed circuit board 3, and leads 4 led out of the telephone connector 2 are connected to the printed circuit board 3 through a connector 5.

As depicted in FIG. 2, the telephone connector 2 heretofore employed comprises an insulating body 10 of a synthetic resinous material, terminals 11 fitted therein and contact members 14 electrically integrated with the terminals 11 for contact with contacts 13 of a telephone plug 12.

The insulating body 10 has a plug receiving hole 10A. When the plug 12 is inserted into the hole 10A, the contacts 13 come into contact with the contact members 14, establishing electrical connection between the leads 15 of the terminals 11 and wires of a cord 16 connected to the contacts 13.

As will be seen from the above, the conventional telephone connector is formed, by a molding of synthetic resin, as the one-piece insulating body 10 which has the portion for holding the terminals 11 and the hole 10A for receiving the plug 12. Accordingly, the walls of the insulating body 10 need to be 1 mm or more thick so as to have a sufficient mechanical strength, and hence is inevitably bulky. Further, in order to provide electromagnetic shielding, the insulating body 10 must be covered on the outside thereof with a shielding material, and this also will lead to the bulkiness of the conventional telephone connector.

SUMMARY OF THE INVENTION

It is therefore an object of the present invention to provide a telephone connector which can be formed smaller in size than prior art telephone connectors, and which has an electromagnetic shielding effect.

According to the present invention, terminals are held in a connector body of an insulating material, the connector body has grooves cut into both sides thereof and extending in its front-to-back direction, and a U-shaped metal cover is locked to the connector body with both side marginal portions of the cover fitted into the grooves of the connector body.

Three sides of the plug receiving hole are defined by the U-shaped metal cover. This makes it possible to reduce the thickness of the telephone connector, permits its miniaturization and provides the electromagnetic shielding effect.

DESCRIPTION OF THE PREFERRED EMBODIMENTS

Figure 1:
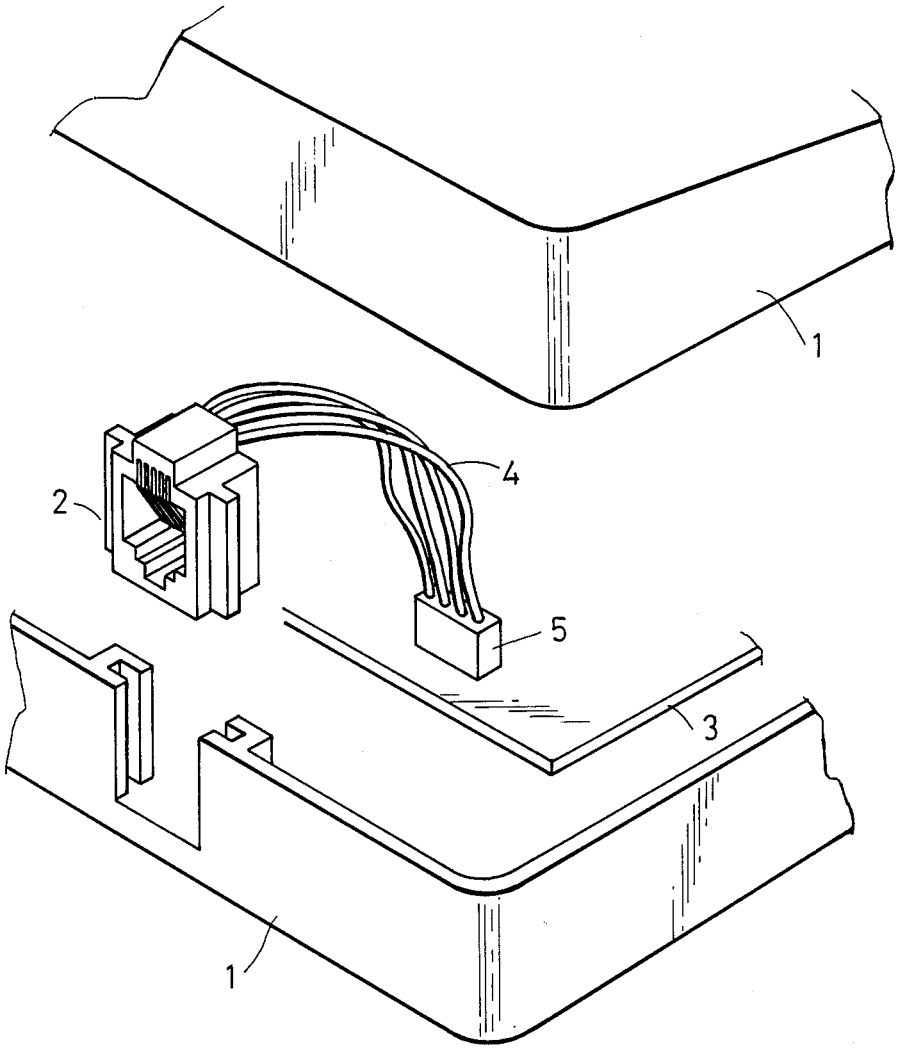
FIG. 1 PRIOR ART
FIG. 1 is an exploded perspective view showing an example of the manner in which a conventional telephone connector is attached to the body of a telephone set.
Figure 2:
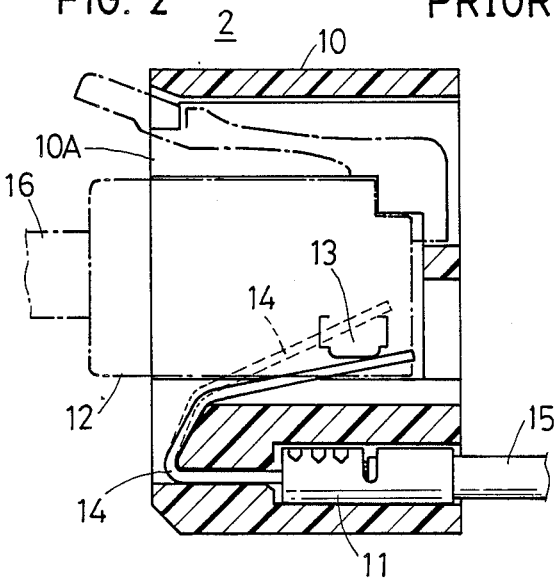
FIG. 2 PRIOR ART
FIG. 2 is a sectional view showing the conventional telephone connector.
Figure 3:
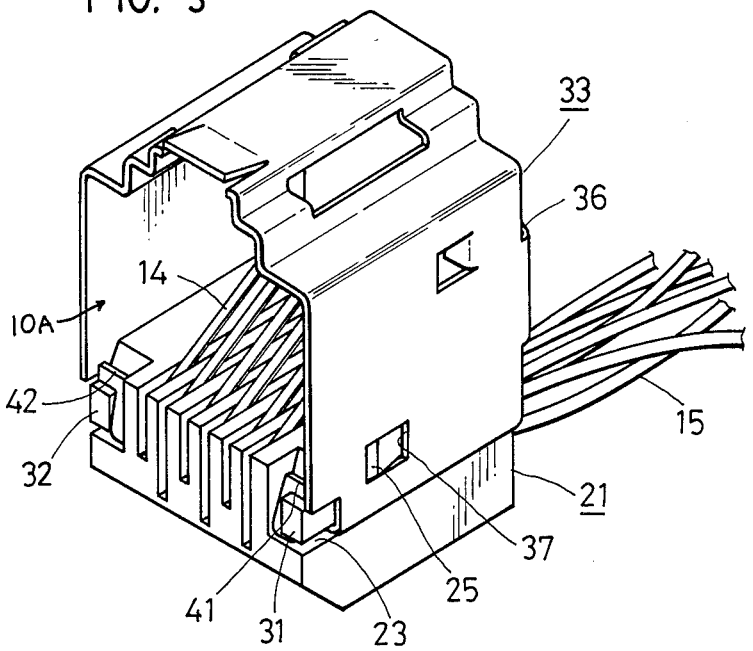
FIG. 3 is a perspective view illustrating an example of the telephone connector of the present invention.
Figure 4:
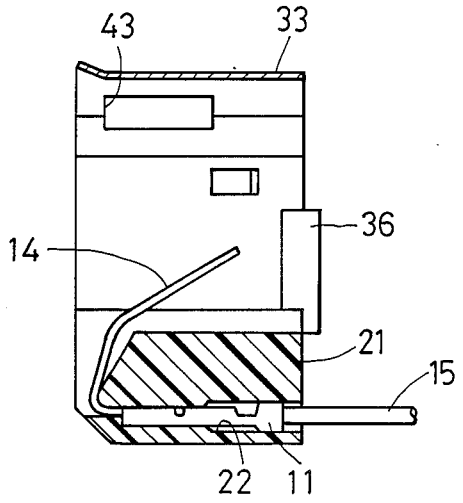
FIG. 4 is a sectional view of FIG. 3.
Figure 5:
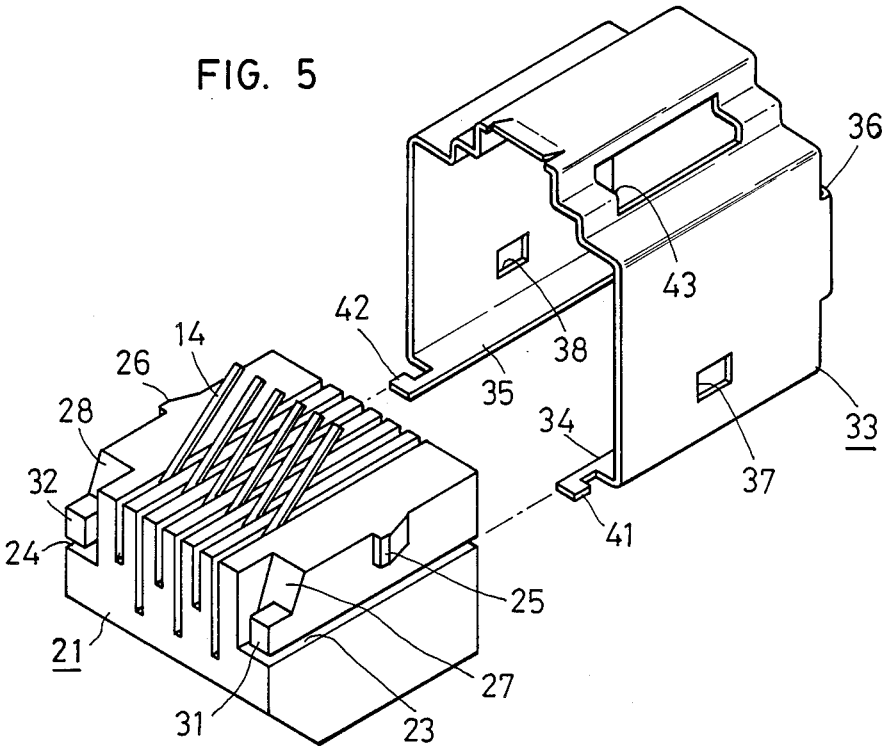
FIG. 5 is an exploded perspective view of FIG. 3.

FIGS. 3 through 5 illustrate an embodiment of the present invention. A connector body 21 of a synthetic resinous material is substantially a rectangular parallelpiped, which has terminal housing holes 22 extending therethrough in its front-to-back direction, the terminals, 11 being housed in the holes 22. The front end portion of each terminal 11 is turned up, forming the resilient contact portion 14. The connector body 21 has side grooves 23 and 24 in its opposite sides and extending in the front-to-back direction of the connector. The connector body 21 also has lugs 25 and 26 protrusively provided on both sides thereof above the side grooves 23 and 24, respectively. Moreover, the connector body 21 has at both upper front corners thereof recesses 27 and 28 in communication with the side grooves 23 and 24, leaving protrusions 31 and 32, respectively.

A U-shaped metal cover 33 is mounted on the connector body 21 to define the plug receiving hole 10A. The U-shaped cover 33 has a pair of opposite side walls whose lower end portions are bent inwardly to form engaging marginal portions 34 and 35, which are slideably fitted into the side grooves 23 and 24 in the connector body 21, respectively. The cover 33 is engaged with the connector body 21 by pushing the cover forward relative to body 21. When stoppers 36 at the rear edge of the cover side walls abut against the back of the connector body 21, lugs 25 and 26 of the connector body 21 engage holes 37 and 38 in the cover side wall, respectively, thus locking the cover 33 to the connector body 21. Then, L-shaped engaging pieces 41 and 42 extending from the front ends of the engaging marginal portions 34 and 35 of the cover 33 are turned up so that they are inserted into the recesses 27 and 28 of the connector body 21 and engaged with the protrusions 31 and 32, respectively, thereby ensuring the locking of the cover 33 to the connector body 21. The top panel of the cover 33 is raised in two steps toward its central portion and has in its stepped portions notches 43 for locking the plug.

Figure 6:
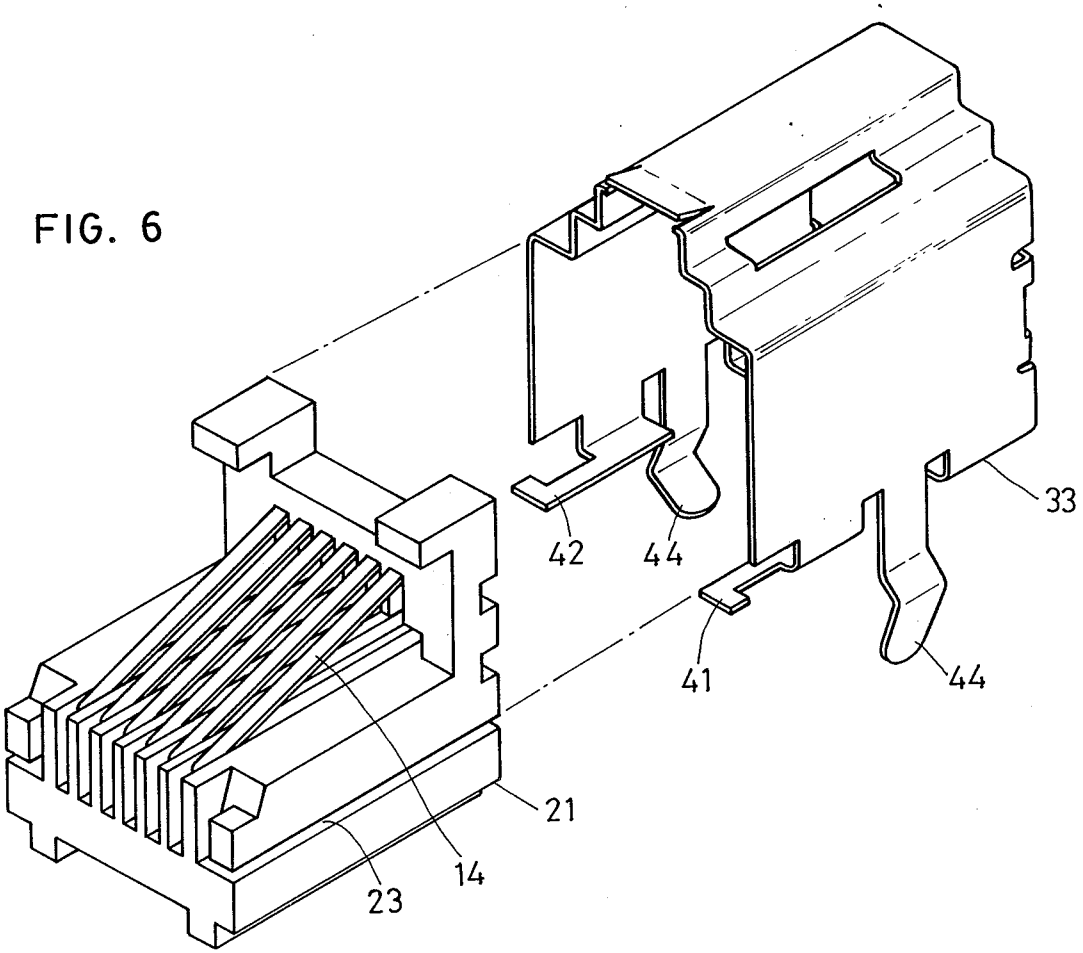
FIG. 6 is an exploded perspective view of another example of the present invention.
Figure 7:
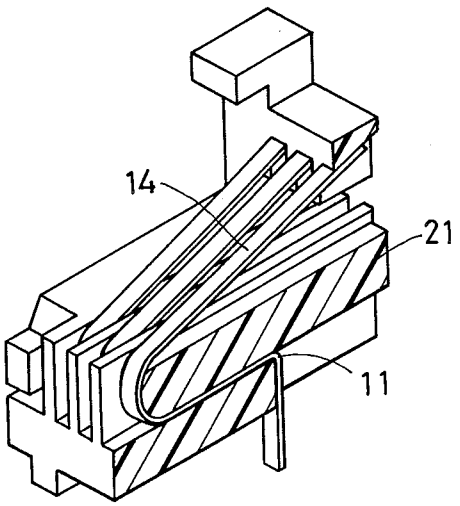
FIG. 7 is a partly cut away perspective view of the connector body 21 in FIG. 6.

While in the above embodiment of the invention the leads 15 are connected to the terminals 11, the present invention is also applicable to a telephone connector in which the terminals 11 are connected directly to a printed circuit board as exemplified in FIGS. 6 and 7, in which the parts corresponding to those in FIGS. 3 to 5 are identified by the same reference numerals. In this example the terminal 11 received in each terminal housing hole 22 is bent downward at its intermediate portion so that it projects out of the bottom of the connector body 21, as depicted in FIG. 7. A terminal lug 44 extends downwardly from the lower portion of each side wall of the cover 33 as shown in FIG. 6. The terminal lugs 44 are to be inserted into slots in a printed circuit board and soldered thereto.

As described above, according to the present invention, since three sides of the plug receiving hole 10A are defined by the metal cover 33, the portion of the connector covering the hole 10A can be made thinner than in the case of the conventional telephone connector formed as a one-piece body of a synthetic resinous material. Thus, the telephone connector of the present invention can be made smaller in size. Moreover, the metal cover 33 provides the desired electromagnetic shielding effect.

It will be apparent that many modifications and variations may be effected without departing from the scope of the novel concepts of the present invention.

What is claimed is:

1. A telephone connector comprising:

a connector body fabricated of a resinous material and having terminal housing holes formed therein, said connector body having a pair of opposite side surfaces and front and back surfaces, said side surfaces respectively having side grooves therein extending in a front-to-back direction of said connector body;

terminals housed in said terminal housing holes, each of said terminals having a resilient contact portion at one end thereof; and a substantially U-shaped metal cover having a pair of spaced opposite sides which respectively include inwardly extending marginal portions that are fitted into said side grooves of said connector body, whereby said U-shaped metal cover defines three sides of a plug receiving hole and the fourth side of said plug receiving hole is defined by said connector body, said spaced opposite sides of said U-shaped metal cover also having stoppers extending inwardly at the rear end of said metal cover into abutment with said back surface of said connector body, and the front end of said metal cover further having engaging pieces extending respectively from said spaced opposite sides of said U-shaped metal cover into engagement with said front surface of said connector body.

2. The telephone connector of claim 1 wherein said front surface of the connector body has a pair of recesses in communication respectively with said side grooves, leaving a pair of protrusions that are located respectively adjacent the front ends of said side grooves, said engaging pieces of the metal cover being L-shaped and inserted into said recesses for engagement with said protrusions, respectively.

3. The telephone connector of claim 1 wherein said connector body has a pair of outwardly protruding lugs on its opposite side surfaces for respective engagement with engaging holes in said metal cover.

4. The telephone connector of claim 1 wherein a central portion of said metal cover is raised in two steps to form stepped portions of said cover between the said opposite sides of said cover, said stepped portions of said cover having notches formed therein for locking a plug that is inserted into said plug receiving hole.

5. The telephone connector of claim 1 wherein said resilient contact portion is at the front end of each terminal and a lead is connected to the rear end of each terminal and is led out of the connector body.

6. The telephone connector of claim 1 wherein each terminal includes a portion which extends downwardly and projects out of a bottom surface of the connector body.

7. The telephone connector of claim 6 wherein said metal cover has terminal lugs extending downwardly from said spaced opposite sides of said cover.

* * * * *